US005855485A

United States Patent [19]

Patti

[11] Patent Number: 5,855,485

[45] Date of Patent: Jan. 5, 1999

[54] MULTIPLE TRACK ADAPTER FOR TRACK LIGHTING SYSTEMS

[76] Inventor: Anthony G. Patti, 270 S. Burton, San Gabriel, Calif. 91776

[21] Appl. No.: 783,891

[22] Filed: Jan. 16, 1997

[51] Int. Cl.[6] ..... H01R 25/14

[52] U.S. Cl. ..... 439/121

[58] Field of Search ..... 439/121, 122, 439/94, 116–119

[56] References Cited

U.S. PATENT DOCUMENTS

| | | | |
|---|---|---|---|
| 3,120,985 | 2/1964 | Hubbell . | |
| 3,273,103 | 9/1966 | Ericson . | |
| 3,391,377 | 7/1968 | Corl et al. . | |
| 3,559,146 | 1/1971 | Valtonen | 439/94 |
| 3,646,501 | 2/1972 | Valtonen . | |
| 3,686,614 | 8/1972 | Hyrylainen . | |
| 3,718,886 | 2/1973 | Hoffmeister . | |
| 3,832,503 | 8/1974 | Crane . | |
| 3,848,715 | 11/1974 | Hesse . | |
| 3,884,541 | 5/1975 | O'Nan et al. . | |
| 3,894,781 | 7/1975 | Donato . | |
| 3,933,403 | 1/1976 | Rubesamen et al. . | |
| 3,980,368 | 9/1976 | Fremont . | |
| 3,993,385 | 11/1976 | Seger . | |
| 4,029,378 | 6/1977 | Bolis | 439/94 |
| 4,032,208 | 6/1977 | Berkenhoff . | |
| 4,108,523 | 8/1978 | Bolis . | |
| 4,139,252 | 2/1979 | Gorny | 439/94 |
| 4,181,388 | 1/1980 | Donato . | |
| 4,218,108 | 8/1980 | El Mouchi . | |
| 4,289,365 | 9/1981 | Rutgers . | |
| 4,533,190 | 8/1985 | Booty . | |
| 4,655,520 | 4/1987 | Cummings . | |
| 4,676,567 | 6/1987 | Mouchi | 439/116 |
| 4,699,439 | 10/1987 | Cohen | 439/119 |
| 4,790,766 | 12/1988 | Booty, Sr. et al. | 439/122 |
| 4,822,292 | 4/1989 | Thayer et al. | 439/115 |
| 4,887,196 | 12/1989 | Brown et al. | 362/148 |
| 4,968,262 | 11/1990 | Widell et al. | 439/121 |
| 5,013,251 | 5/1991 | Stringer et al. | 439/94 |
| 5,151,038 | 9/1992 | Range et al. | 439/122 |
| 5,336,097 | 8/1994 | Williamson, Jr. et al. | 439/94 |

FOREIGN PATENT DOCUMENTS

| | | | |
|---|---|---|---|
| 3811128 | 3/1990 | Germany | 439/122 |

*Primary Examiner*—Gary F. Paumen
*Attorney, Agent, or Firm*—Hill & Simpson

[57] ABSTRACT

An adapter is provided for making a mechanical and an electrical connection between a light fixture and a plurality of differently configured tracks of different track lighting systems. By utilizing the adapter of the present invention, a light fixture may be mechanically and electrically connected to differently configured tracks manufactured by different manufacturers.

27 Claims, 4 Drawing Sheets

FIG. 1
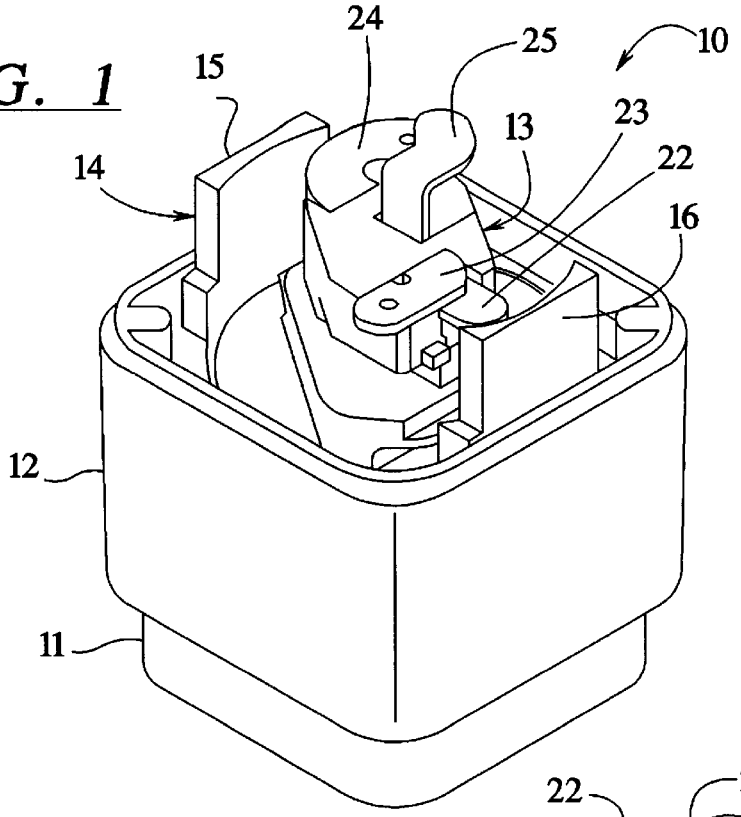
FIG. 1A
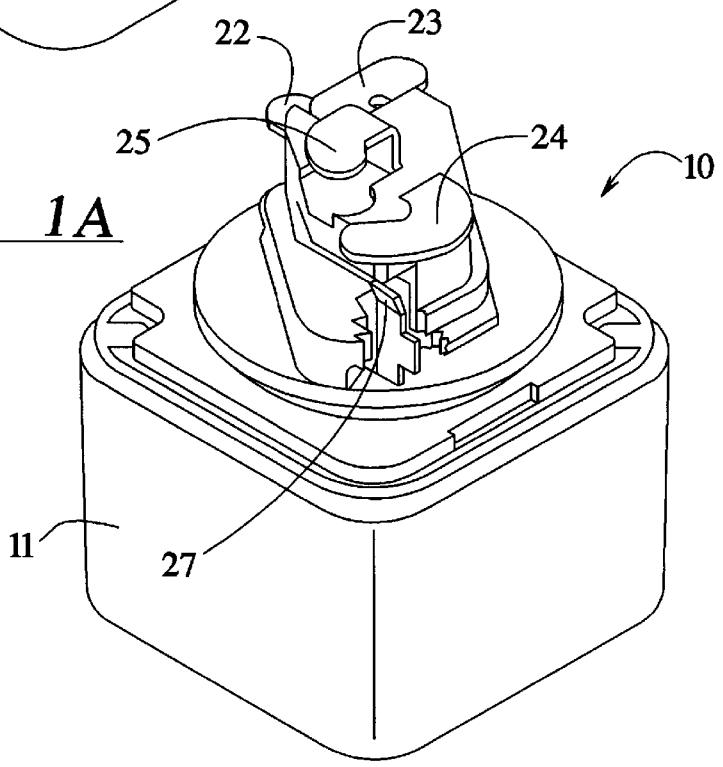
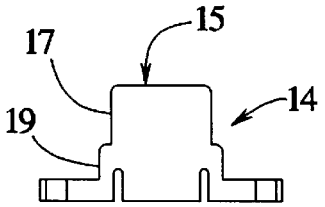
FIG. 23

FIG. 24
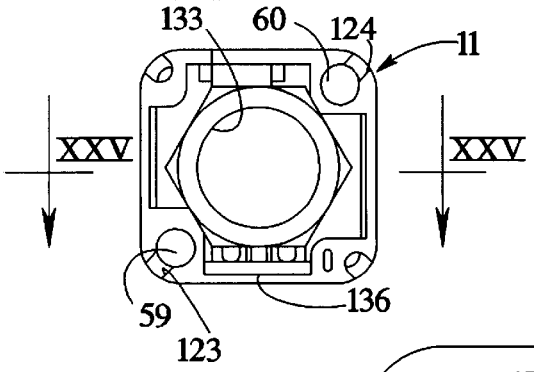
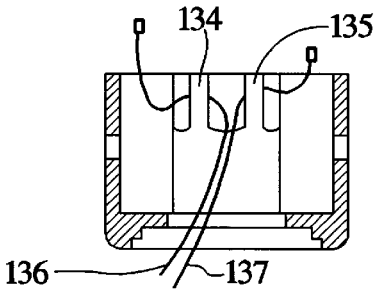
FIG. 25
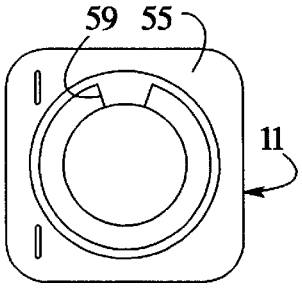
FIG. 26
FIG. 2
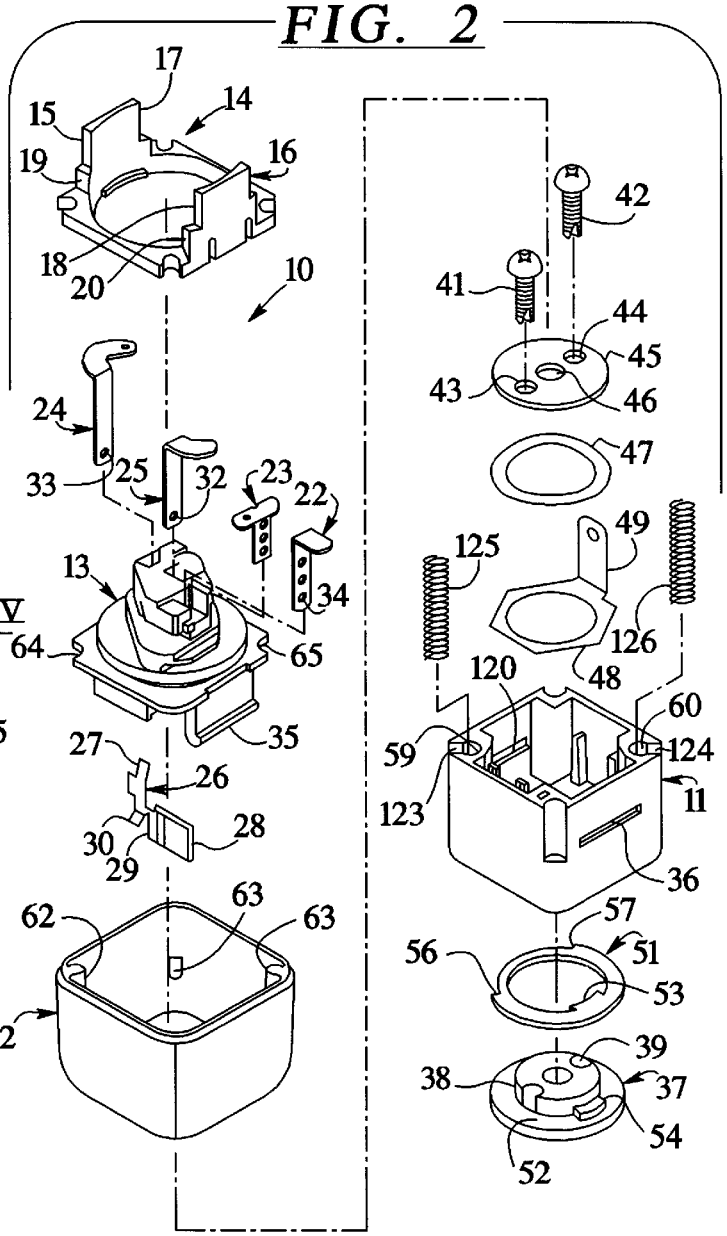
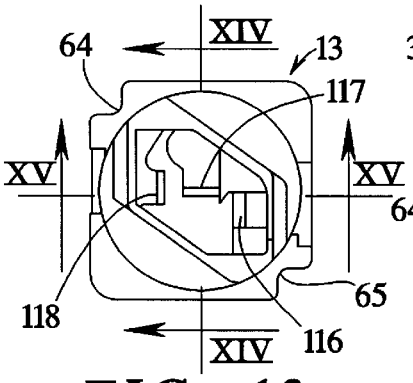
FIG. 12
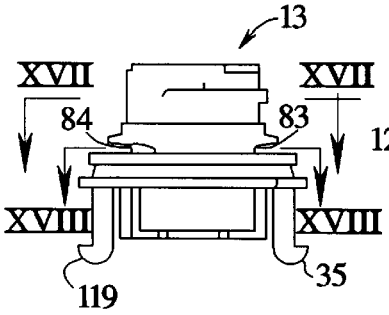
FIG. 13

MULTIPLE TRACK ADAPTER FOR TRACK LIGHTING SYSTEMS

FIELD OF THE INVENTION

The present invention relates generally to track lighting systems and more specifically, to an adapter for connecting a light fixture at any point along a track of a track lighting system. Still more specifically, the present invention relates to an adapter for connecting a light fixture to any one of differently configured tracks of different track lighting systems.

BACKGROUND OF THE INVENTION

Track lighting systems are known. A typical track lighting system includes two primary components. First, a track having a generally inverted C-shaped cross section is mounted to a ceiling or a wall. The track typically has a top wall disposed between two downwardly extending arms which terminate in two inwardly extended ledges to form a central channel. Inserts are typically disposed between each ledge and the top wall for the purpose of accommodating one or more conductors. The inserts are typically fabricated from a plastic material that insulates the conductors from each other and from the track if the track is fabricated from metal.

The track lighting fixture or light fixture is attached to the track by inserting the adapter mounted to the fixture through the central channel of the track. A typical adapter includes two or more tangs that extend outwardly which, when twisted, are frictionally secured above the ledges of the track. Conductor engaging tabs also extend outwardly from the top end of the adapters which engage the conductor when the adapter is locked into place above the ledges of the track.

Further, three types of grounding mechanisms are typically provided for track lighting systems. For metallic tracks which also serve as a ground conductor, a metallic tab may be provided that extends outward from the adapter to provide a scraping engagement between the grounding tab and the ledge of the conductor. Another configuration is to provide an upwardly extending grounding tab that engages a top wall of the track, assuming the top wall of the track is not lined with an insulating insert material. Other track lighting systems employ a separate conductor which is accommodated in an insert for grounding purposes. For these systems, a separate conductor engaging tab must be provided in the top end of the adapter head.

Three different tracks having three different structural configurations and that are used with three different track lighting systems are illustrated in FIGS. 3–8. The three different lighting systems are sold under the CAPRI, HALO and JUNO trademarks. As can be seen from FIGS. 3–5 which illustrate the CAPRI track, FIGS. 6–8 which illustrate the HALO track and FIGS. 9–11 which illustrate the JUNO track, the CAPRI, HALO and JUNO tracks are dimensioned differently and, prior to the present invention required a specially designed adapter for each track.

Previously, an adapter attached to a CAPRI light fixture which is designed to fit a CAPRI track would not fit into either a HALO or a JUNO track. Similarly, an adapter attached to a HALO light fixture which is designed to fit a HALO track would not fit into either a CAPRI or a JUNO track. Finally, an adapter attached to a JUNO light fixture designed for a JUNO track would not fit into either a HALO track or a CAPRI track.

Thus, after a consumer has installed one of the currently available track lighting systems onto a ceiling, and the consumer later decides to change the decor of the room by changing light fixtures, the consumer is forced to choose a light fixture fabricated by the manufacturer of his or her original track lighting system or a light fixture that is designed specifically to fit that system. In essence, once a consumer chooses a CAPRI system, a HALO system or a JUNO system, and the consumer later decides to change the light fixtures, the consumer is limited to choosing fixtures equipped with adapters specifically designed to fit the original system. If the consumer chooses a light fixture that cannot fit the consumer's original track, the only alternative left to the consumer is to choose a different light fixture or replace the pre-existing track.

Therefore, by incorporating different design features in their tracks, competing manufacturers have prevented consumers from installing the light fixtures of their competitors onto their tracks and have effectively limited the consumer's choices of replacement light fixtures to light fixtures made by the manufacturers of the consumer's existing track lighting system. If the consumer is not satisfied with the variety of styles of replacement light fixtures offered by a particular manufacturer and the consumer's already installed track is made by that particular manufacturer, the consumer's only alternative is to install new track. This is an expensive and labor intensive prospect.

Therefore, there is a need on the part of consumers for an adapter that enables the attachment of light fixtures to a plurality of differently configured tracks made by different manufacturers. When such an adapter is attached to a light fixture, owners of track lighting systems made by any one of the three or more primary manufacturers would be able to install the light fixtures on their pre-existing track as a replacement light fixture. Consumers would no longer have to be forced or limited to choosing replacement light fixtures from the manufacturer of their currently installed track. Such an adapter would greatly expand the selection of replacement light fixtures currently available to consumers. Such an adapter would also enable manufacturers to expand the market for their current replacement light fixtures because the light fixtures would be able to be attached to all of the major track lighting systems instead of a specific track lighting system manufactured by a single manufacturer.

SUMMARY OF THE INVENTION

The above-mentioned needs are satisfied by the present invention which provides a track lighting adapter for mechanically and electrically connecting a track light fixture to a plurality of differently dimensioned or configured tracks. In essence, the track lighting adapter of the present invention, when attached to a light fixture, enables that light fixture to be attached to at least any one of the three differently configured tracks manufactured by the three primary manufacturers of track lighting systems.

A track lighting adapter made in accordance with the present invention mechanically and electrically connects a light fixture to any one of a plurality of differently configured tracks of the type having a top wall disposed between a first and second downwardly extending arm in a generally inverted U-shaped configuration. Each arm is connected to an inwardly extending ledge. Two ledges define a central channel or a central slot which accommodates the adapter. Each side of the track also includes an insert, typically made of plastic, that accommodates at least one conductor. The spacing of the conductors between the ledge and the top wall varies from manufacturer to manufacturer as well as the thickness of the ledges. Each track also includes a ground conductor which may be a separate conductor wire or the metallic track itself.

The adapter of the present invention includes a contact head having a top end for insertion through the central channel of the track and a bottom end that is connected to a main housing which, in turn, is connected to the light fixture. The top end of the contact head includes two separate ground contact tabs, a first tab that is spring biased upward for engaging the top wall of at least one of the currently available tracks, a ground conductor of at least one of the currently-available tracks and a second scraping type ground contact tab that engages one of the ledges of the other currently available tracks. The top end of the contact head further includes two line (or positive) conductor contact tabs for engaging the line (or positive) conductors of the tracks and at least one neutral conductor contact tab for engaging the neutral conductors of the tracks. The line conductor contact tabs are disposed on the same side of the contact head and are vertically displaced from one another to accommodate the differences in the spacing of the line conductor amongst the tracks of the various manufacturers.

In an embodiment, the line conductor contact tabs are disposed on an opposing side of the top end of the contact head from the neutral conductor contact tab.

In an embodiment, the top end of the contact head further comprises a fist lower pair of opposing slots for engaging the first and second ledges of at least one of the currently-available tracks and a second upper pair of opposing slots for engaging the first and second ledges of at least one of the currently available tracks. The first lower pair of opposing slots and the second upper pair of opposing slots being vertically displaced from one another.

In an embodiment, one of the upper opposing slots is wider or thicker than the other upper opposing slot.

In an embodiment, the first lower pair of opposing slots accommodate the first and second ledges of the CAPRI track.

In an embodiment, the second upper pair of opposing slots engage the first and second ledges of the HALO and JUNO tracks.

In an embodiment, the adapter of the present invention includes a lock ring mounted over the top end of the contact head. The lock ring includes an annular base for accommodating the top head of the contact head and two upwardly extending and opposing tabs. The tabs are accommodated in the central channel of the track.

In an embodiment, the tabs of the lock ring of the present invention each include a narrow top portion and a wider bottom portion. The narrow top portion is sufficiently narrow to be inserted through the central channel of the currently available tracks. In contrast, the wider bottom portion is accommodated in the central channel of at least one of the currently available tracks and is wider than the central channels of at least two of the currently available tracks. Accordingly, the wider bottom portion of the tabs of the lock ring control the depth in which the lock ring, and consequently the contact head, can be inserted into the central channels of the tracks that are narrower than the bottom portions of the tabs of the lock ring.

In an embodiment, the adapter of the present invention provides an automatic polarity matching mechanism by way of at least one stop barrier disposed on the contact head which prevents rotation of the contact head in such a way as to align one or more of the line conductor contact tabs with a neutral conductor of one of the currently available tracks.

In an embodiment, the present invention includes an automatic polarity matching system which includes at least one stop barrier disposed on the top end of the contact head which prevents rotation of the contact head so as to align or contact the neutral conductor contact tab with a line conductor of one of the currently available tracks.

In an embodiment, the adapter of the present invention includes a contact head having two ground contact tabs, two line conductor contact tabs and one neutral conductor contact tab.

In an embodiment, one of the ground contact tabs of the adapter of the present invention is spring biased upward and the other ground contact tab extends outward from a side of the contact head.

In an embodiment, at least one of the line conductor contact tabs of the present invention is vertically disposed above the other line conductor contact tab.

In an embodiment, in addition to being vertically displaced from one another, the line conductor contact tab is directed outward or from the contact head body at approximately right angles with respect to each other.

In an embodiment, the contact head of the present invention includes two pairs of vertically displaced slots. A lower pair of opposing slots are intended to accommodate the first and second ledges of at least one of the currently-available tracks. The upper pair of opposing slots are intended to accommodate the first and second ledges of at least two of the currently-available tracks.

In an embodiment, the second upper pair of opposing slots have different thicknesses for engaging first and second ledges of tracks that have different thicknesses. More specifically, in an embodiment, the second upper pair of opposing slots include one wider slot and one narrower slot because at least two of the currently available tracks have one thick ledge and one thin ledge. The thick ledge being accommodated in the thick upper slot and the thin ledge being accommodated in the thin upper slot. Further, the employment of two upper slots of different thicknesses provide for an automatic polarity matching mechanism because the contact head cannot be rotated the wrong way because a thick ledge cannot be accommodated in a thin upper slot.

The present invention also provides an improved ground contact mechanism for track light fixture adapters. The ground contact mechanism of the present invention includes a spring lever which has an upper end biased in an upward direction and a lower end connected to a clip for attaching the mechanism to an adapter, the clip is also connected to a grounding post which includes an upwardly extending scraper end.

In an embodiment, the spring lever of the ground contact mechanism of the present invention is employed to bias a ground contact tab upward against a top wall of a currently-available track.

In an embodiment, the ground contact tab engages a separate neutral conductor of at least one currently available track.

In an embodiment, the scraper end of the grounding post of the ground contact mechanism of the present invention provides a ground contact with a ledge of at least one currently available track.

The present invention also provides an improved combination lock ring and shock preventor for a track light fixture adapter. The lock ring comprises an annular base ring which includes two upwardly extending and opposing tabs. The tabs of the lock ring are accommodated in the central channels of at least three currently available tracks and prevent a finger from engaging a conductor tab of the adapter when the conductor tab is in place and in engagement with a conductor wire of the track.

In an embodiment, the upwardly extending tabs of the lock ring include a narrow top portion and a wide bottom portion. The narrow top portion being sufficiently narrow so as to be accommodated in the openings of at least three currently available track configurations, the wide bottom portion being selectively wider than the central openings of at least two of the currently-available track configurations.

The present invention also provides an improved housing for an adapter used to connect a track light fixture to different track configurations. The housing includes a shell with a bottom having an opening through which two wires pass that electrically connect the light fixture to the contact head of the adapter. The shell further comprises a vertical wall with two upwardly extending posts spaced apart from each other and spaced apart from the wall. One of the wires extends upward and around one of said posts before being connected to the contact head, the other wire extending upward and around the other of said posts before being connected to the contact head. The engagement between the wires and the posts provides a cord lock and strain relief in the event stress is applied to the wires after they are connected to the contact head.

An advantage of the present invention is that it provides an adapter for a track light fixture that enables the light fixture to be connected to any one of three currently-available track configurations.

Another advantage of the present invention is that it provides an adapter for a track light fixture with improved shock prevention.

Another advantage of the present invention is that it provides an adapter for a track light fixture with automatic polarity matching between the light fixture and the track.

Still another advantage of the present invention is that it provides an adapter for a track lighting fixture that enables the fixtures to be utilized in a plurality of different track configurations.

Yet another advantage of the present invention is that it makes track light fixtures equipped with an adapter made in accordance with the present invention interchangeable between at least three currently-available track configurations.

Another advantage of the present invention is that it provides an improved grounding mechanism for different track configurations.

Another advantage of the present invention is that it provides an improved housing for an adapter for a track light fixture which provides improved strain relief for the wires connecting the track light fixture to the contact head of the adapter.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be made to the embodiment illustrated in greater detail in the accompanying drawings and described below by way of an example of the invention.

FIG. 1 is a perspective view of an adapter made in accordance with the present invention.

FIG. 1A is another partial perspective view of the adapter of FIG. 1.

FIG. 2 is an exploded perspective view of the adapter shown in FIG. 1.

FIG. 12 is a plan view of the contact head of the adapter of the present invention.

FIG. 13 is an elevational view of the contact head of FIG. 9.

FIG. 23 is a side elevational view of the lock ring of FIG. 21.

FIG. 24 is a top plan view of the main housing of the adapter of the present invention.

FIG. 25 is a sectional view taken along line 25—25 of FIG. 24.

FIG. 26 is a bottom plan view of the main housing of FIG. 24.

Figure 3:
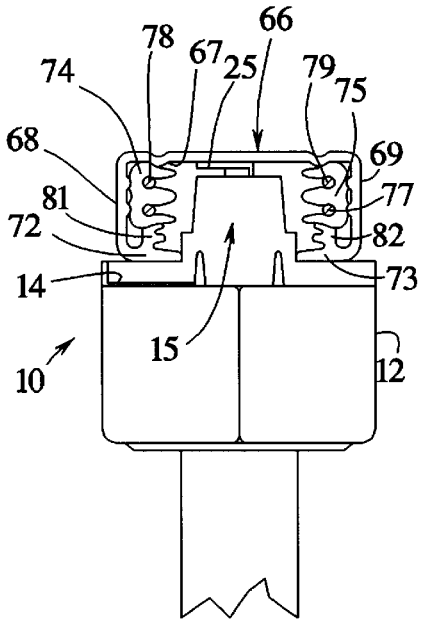
FIG. 3 is an end view of a currently-available track with the adapter of FIG. 1 of the present invention inserted into the central channel of the track.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS

Turning first to FIG. 1, the perspective view of an adapter 10 made in accordance with the present invention is illustrated. The adapter 10 includes a main housing 11 which passes through a sliding lock collar 12. The main housing also accommodates and is connected to a contact head 13, a top end of which is accommodated within a lock ring 14. These main parts are further illustrated in more detail in the exploded view shown in FIG. 2. FIG. 1A provides a partial perspective of the adapter 10 view from an opposing angle to that of FIG. 1 and particularly illustrates the ground scraper contact 27 which is discussed in detail below.

Turning to FIG. 2, the lock ring 14 includes two upwardly protruding tabs 15, 16. The tabs 15, 16 each include a narrower upper portion 17, 18 respectively which extend upward from wider bottom portions 18, 19 respectively. The tabs 15, 16, with the narrower portions 17, 18 and wider portions 19, 20 permit the slide lock collar to selectively fit within any one of the three currently-available track configurations illustrated below in FIGS. 3–11.

Figure 4:
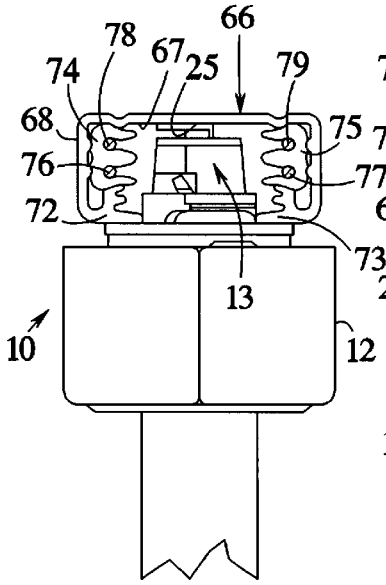
FIG. 4 is another end view of the track and adapter shown in FIG. 3.
Figure 5:
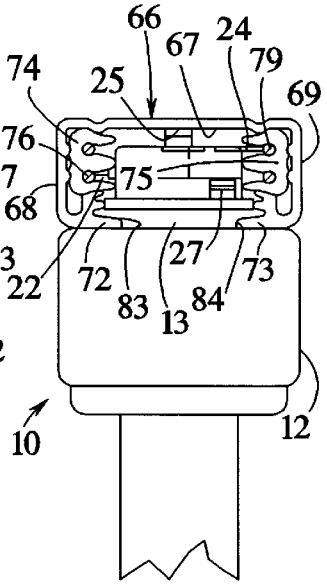
FIG. 5 is another end view of the track and adapter shown in FIG. 3.
Figure 6:
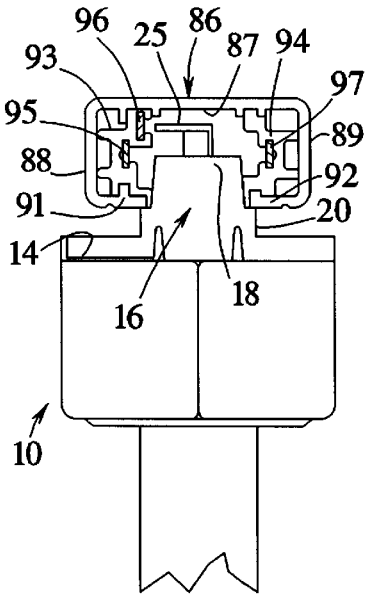
FIG. 6 is an end view of a second currently available track with the adapter of FIG. 1 inserted into the central channel of the track.
Figure 7:
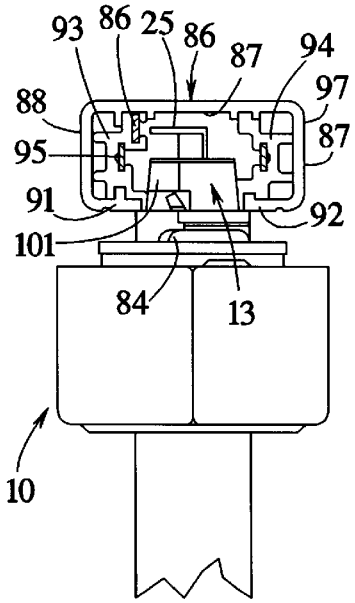
FIG. 7 is another end view of the track and adapter of FIG. 6.
Figure 8:
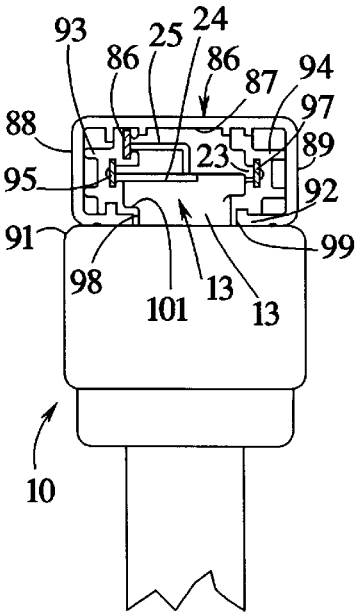
FIG. 8 is another end view of the track and adapter of FIG. 6.

Returning to FIG. 2, the adapter 10 also includes three contact tabs 22, 23, 24. The contact tabs 22, 23 are tabs for engaging the line conductors of the tracks, as further illustrated in FIGS. 3–11 while the contact tab 24 engages the neutral conductor of all three tracks illustrated in FIGS. 3–11. Returning to FIG. 2, the adapter 10 as illustrated also includes a first ground contact tab 25 which, as illustrated in FIGS. 3–5, engages a top wall of a track to ground the light fixture or, as illustrated in FIGS. 6–8, engages a separate ground conductor. The adapter 10 also includes a second ground contact in the form of a separate upwardly extending ground post 26 which features an upper scraping end 27 for engaging a ledge or side rail of a track as illustrated in FIGS. 7–8 and 10–11. The grounding post 26 is connected to a U-shaped clip 28 which is also connected to a spring arm shown at 29. The spring arm 29 includes an upper distal end 30 which, when assembled, is accommodated in the slot 32 disposed at a lower end of the ground contact tab 25. The spring arm 29 biases the ground contact tab 25 upward so that it may engage the top wall of the track as illustrated in FIGS. 3–5.

The neutral conductor contact tab 24 includes a hole 33 disposed at a lower end thereof and the line conductor contact tab 22 also includes a hole 34 disposed at a lower end thereof for attachment to the neutral end line leads (not shown) coming from the light fixture (not shown). As shown in FIG. 1, the line conductor contact tabs 22, 23 are arranged in a stacked relationship within the contact head body 13. In an alternative embodiment, the contact tabs 22, 23 may be fabricated from a single piece of metal or be pre-attached to one another.

Still referring to FIG. 2, contact head 13 includes a downwardly extending tongue 35 which is accommodated in a slot 36 disposed in the housing 11 for ease of assembly. In addition to the necessary slots for accommodating the line conductor contact tabs 22, 23, neutral conductor contact tab 24, ground contact tab 25 and ground scraper element 27, the contact head body 13 also includes a plurality of slots and stop barriers that are described below in connection with FIGS. 12–15.

Still referring primarily to FIG. 2, the main housing 11 provides the connection between the contact head 13 and the light fixture (not shown). Specifically, a bushing 37 is provided with two holes 38, 39 which accommodate the screws 41, 42 which attach the bushing to the fixture. The screws 41, 42 pass through the holes 43, 44 of the washer 45 which also includes a center hole 46 for accommodating the lead wires of the light fixture (not shown). The washer is disposed on top of a wavy or undulating washer 47 which provides some resistance to the pivotal connection between the washer 45 and the bushing 37 so that the fixture maintains its position and is not rotated or shifted by normal household or environmental vibrations. An additional washer 48 with a ground connecting tab 49 is disposed between the wavy washer 47 and the over-center ring 51. The over-center ring 51 rides on top of the flange 52 of the bushing 37 and provides less than 360° of rotation due to the engagement of the tab 53 on the over-center ring 51 with the step 54 disposed on the bushing 37. However, more than 360° of rotation is provided because the over-center ring 51 is free to rotate with respect to the bottom 55 of the housing 11 until one of the steps on the over-center ring 51 shown at 56, 57 in FIG. 2 engaged the step shown at 58 in FIG. 26. The springs 125, 126 are disposed in the vertical passages 59, 60 which have a bottom (see FIGS. 24 and 26) and engage the keys 121, 122 disposed at a lower end of the ribs 62, 63 which are disposed in the corners of the sliding collar 12. As a result, the collar 12 is biased in the upward direction and removal and/or installation of the adapter 10 requires an initial pulling down of the collar 12. The ribs 62, 63 slidably engage the indents 64, 65 disposed in the diagonally opposed corners of the contact head body 13.

Figure 9:
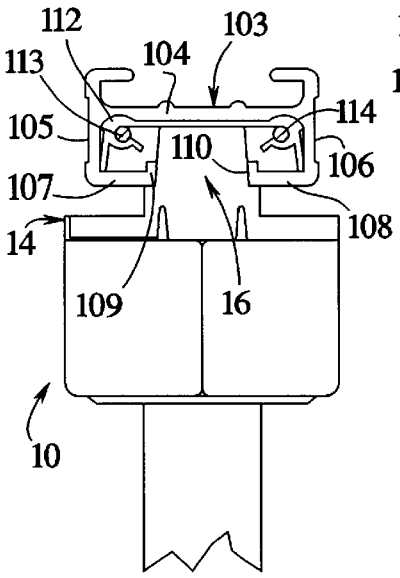
FIG. 9 is an end view of a third currently-available track with the adapter of FIG. 1 inserted into the central channel of the track.
Figure 10:
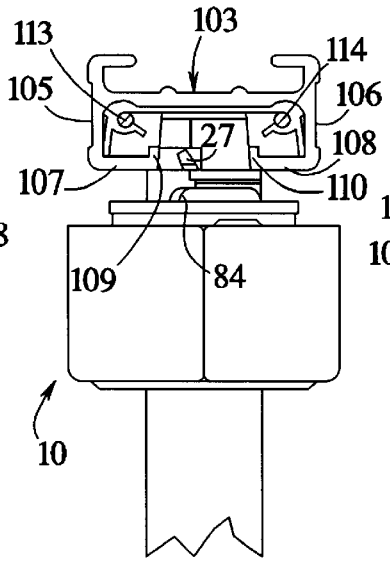
FIG. 10 is another end view of the track and adapter of FIG. 9.
Figure 11:
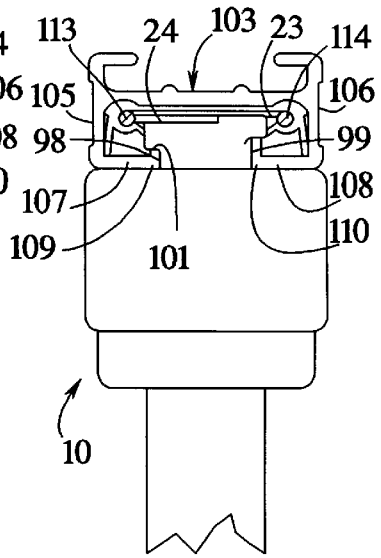
FIG. 11 is another end view of the track and adapter of FIG. 9.

As noted above, the problem addressed by the present invention is the inability of currently available track light fixtures to be fitted or attached to tracks other than the track made by the manufacturer of the fixture because manufacturers have intentionally modified the designs of their tracks so that light fixtures manufactured by other manufacturers and light fixtures not specifically designed for their tracks cannot be used as replacement light fixtures. Specifically, FIGS. 3–9 illustrate three different tracks. FIGS. 3–5 provide and end view of a track sold under the CAPRI trademark. FIGS. 6–8 provide an end view of a track sold under the HALO trademark. FIGS. 9–11 provide an end view of a track sold under the JUNO trademark. As described below, each track is configured differently and imposes individual requirements on the adapter 10.

Specifically referring to FIGS. 3–5, the CAPRI track 66 includes a center or top wall 67 with first and second downwardly extending arms 68, 69. Each arm 68, 69 includes inwardly extending ledges 72, 73 which define a central channel through which the adapter 10 of the present invention has been inserted. The track 66 further includes W-shaped inserts 74, 75 which accommodate line conductor elements 76, 77 and neutral conductor elements 78, 79. The inserts 74, 75 are supported above the ledges 72, 73 by the upwardly protruding extensions 81, 82. Thus, the track 66 as shown in FIGS. 3–5 include two line conductors 76, 77 and two negative conductors 78, 79. The track 66 is also grounded and, as illustrated in FIGS. 3–5, serves as a ground for the light fixture when the upwardly protruding ground tab 25 makes contact with the top wall 67.

To insert the adapter 10 into the track 66 illustrated in FIGS. 3–6, the slide lock collar 12 is pulled downward as illustrated in FIGS. 3–4. The contact head 13 and both tabs 15, 16 of the lock ring 14 have been inserted through the central channel of the track 66. Only the tab 15 is shown in FIG. 3; the tab 15 has been removed from FIGS. 4 and 5 for clarity. After the properly aligned contact head 13 has been inserted through the central channel as shown in FIGS. 3 and 4, the adapter 10 is twisted to the right or in a clockwise direction from the perspective of a consumer reaching upward towards a ceiling to install the light fixture. This rotational movement causes the line conductor contact tab 22 to engage the conductor 76 and further causes the neutral conductor contact tab 24 to engage the neutral conductor 79.

Thus, as seen in FIG. 5, with the lowerly disposed line conductor contact tab 22 engaging the line conductor 76 and with the neutral conductor contact tab 24 engaging the neutral conductor 79 and further with the ground contact tab 25 engaging the top wall 67, an appropriate electrical connection is made between the fixture (not shown) and the track 66. Still referring to FIG. 5, it can be seen that the contact head 13 further includes two lower opposing slots shown at 83 and 84 in FIG. 5 and in FIG. 15. These lower opposed slots are designed to accommodate the relatively thin ledges 72, 73 that are incorporated into the design of the track 66. It will also be noted from FIG. 5 that the ground scraper element 27 that is attached to the clip 28 (see FIG. 2) is not utilized for the track 66. Instead, the spring arm 29 (see FIG. 2) biases the ground contact tab 25 upward so that it engages the top wall 67 of the track 66. Further, once the connection is made as illustrated in FIG. 5, the slide lock collar 12 is biased upward into the position shown in FIG. 5.

In contrast, as shown in FIGS. 6–8, the HALO track 86 includes a different configuration than that of the track 66 shown in FIGS. 3–5. While the track 86 also includes a top wall 87 and downwardly extending first and second arms 88, 89 that terminate in inwardly extending ledges 91, 92, the similarities end there. Specifically, the track 86 includes two differently configured inserts 93, 94. The insert 93 accommodates a line conductor 95 and a separate ground conductor 96. In contrast, the insert 94 accommodates a line conductor 97. Further, the thickness of the ledges 91, 92 is not uniform like the ledges 72, 73 of the track 66. In contrast, as shown in FIGS. 6–8, the ledge 92 is thicker than the ledge 91 and, consequently, the thickness of the portion of the insert 94 that covers the ledge 92 is greater than the thickness of the portion of the insert 93 that covers the ledge 91.

Figure 14:
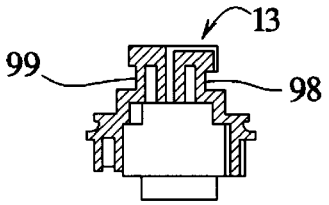
FIG. 14 is a sectional view taken along line 14—14 of FIG. 12.
Figure 15:
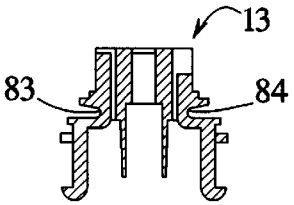
FIG. 15 is a sectional view taken along line 15—15 of FIG. 12.
Figure 16:
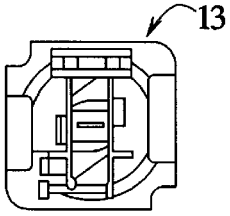
FIG. 16 is a bottom plan view of the contact head of FIG. 12.
Figure 17:
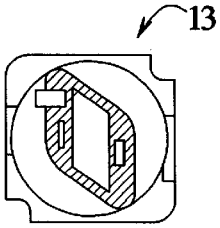
FIG. 17 is a sectional view taken along line 17—17 of FIG. 13.
Figure 18:
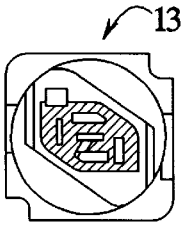
FIG. 18 is a sectional view taken along line 18—18 of FIG. 13.

To accommodate this design feature, the contact head 13, as shown in FIG. 8, includes a pair of upper opposing slots 98, 99 as illustrated in FIGS. 8 and 14. The slot 99 is accommodated over the ledge 92 and the slot 98 is accommodated over the thinner ledge 91. The orientation of these slots 98, 99 also prevent the adapter 10 from being installed in the wrong way or with the wrong polarity. Specifically, because the ledge 92 and the portion of the insert 94 covering the ledge 92 are too thick to be accommodated in the slot 98, any attempt to insert the adapter 10 in the wrong way, or rotated 180° with respect to the appropriate alignment, will result in the thinner slot 98 being aligned with the thicker ledge 92. Because the thicker ledge 92 cannot be accommodated in the thinner slot 98, the portion of the contact head body 13 shown at 101 serves as a stop barrier and prevents the rotation of the adapter 10 when it is inserted through the central channel of the track 86 in the wrong way, or 180° out of phase with respect to the correct alignment.

As illustrated in FIGS. 7 and 8, with the upwardly protruding tab 16 and the contact ring 14 removed for clarity, the contact head 13 (and the tabs 15, 16 of the contact ring 14) are inserted through the central channel of the track 86. The adapter 10 or light fixture is then rotated counterclockwise from the bottom view or the view from the consumer standing on the floor below the track 86 which is normally mounted on the ceiling (not shown). This rotation causes the ground conductor tab 25 to engage the ground conductor 96 and the neutral conductor contact tab 24 to engage the neutral conductor 95. Further, although only partially shown in FIG. 8, the line conductor contact tab 23 has swung around to engage the line conductor 97. It will be noted that the slot 84 which is used in conjunction with the slot 83 to connect the adapter 10 to the track 66 is not utilized to connect the adapter 10 to the track 86 because the lower slots 83, 84 are disposed below the ledges 91, 92 of the track 86.

An additional feature illustrated in FIGS. 6–8 is the use of the upper narrower portion 18 of the tab 16 and the lower wider portion 20 of the tab 16. It will be noted that the central channel of the track 86 is narrower than the central channel of the track 66. As a result, the lower wider portion 20 of the tab 16 cannot fit through the central channel but, instead, is blocked by the ledges 91, 92 and the portion of the inserts 93, 94 that cover the ledges 91, 92 respectively. However, the lower wider portion 20 of the tab 16 (and the lower wider portion 19 of the tab 15—not shown in FIG. 6) serves as an alignment guide and insures that the ground conductor contact tab 25 is appropriately aligned with the ground conductor 96 and that the neutral conductor contact tab 24 and the line conductor contact tab 23 are appropriately aligned with the neutral conductor 95 and line conductor 97 respectively. Hence, the construction of the tabs 15, 16 insures the appropriate depth of insertion of the adapter 10 into the track 86 and the configuration of the channels 98, 99 insures that the adapter 10 can only be connected with the correct polarity.

Turning to FIGS. 9–11, the cross section of a track 103 is illustrated which is sold under the JUNO trademark. While the track 103 has a general H-shaped cross section, the lower half of the track 103 also includes a central wall 104 and downwardly extending first and second walls 105, 106 that terminate in inwardly extending ledges 107, 108 similar to the tracks 66 and 86 illustrated in FIGS. 3–5 and 6–8 respectively. However, again, the similarities end there. Specifically, each ledge 107, 108 terminates in an upwardly protruding lip 109, 110 respectively. The lip 109 is shorter or thinner than the lip 110. No insulation material covers the ledges 107, 108 or the lips 109, 110. A single insert 112 is employed which accommodates the neutral conductor 113 and line conductor 114. While the width of the central channel of the track 103 is generally the same as the central channel of the track 86, the depth of the channel of the track 103 is substantially shallower than that of both the tracks 86 and 66. However, notwithstanding these differences, the adapter 10 provides a mechanical and electrical connection between a light fixture and the track 103 as it does between a light fixture and the tracks 86 and 66.

Specifically, referring to FIG. 9, the contact head body 13 along with the tabs 15, 16 of the lock ring 14 are inserted upward through the central channel of the track 103. Once inserted, if the correct configuration is obtained, the fixture or adapter 10 is rotated in a counterclockwise direction from the user's point of view standing on the floor to the position illustrated in FIG. 11. In the position illustrated in FIG. 11, the ground scraping element 27 disposed at the end of the post 26 (see FIG. 2) has scrapingly engaged the lip 109 of the ledge 107 to provide a ground contact. The neutral conductor contact tab 24 is aligned with and is engaging the neutral conductor 113. While only partially shown in FIG. 11, the line conductor contact tab 23 has swung around and is aligned with and is engaging the line conductor 114. Hence, with the ground scraper 27 engaging the lip 109 of the ledge 107 and with the neutral conductor contact tab 24 engaging the neutral conductor 113 and finally with the line conductor contact tab 23 engaging the line conductor 114, the adapter 10 has provided electrical connection between a light fixture (not shown) and the track 103.

Because the lower notch or channel 99 must accommodate the wider lip 110, there is only one way to connect the adapter 10 to the track 103. Any attempt to connect the adapter 10 out of orientation by 180° would result in the narrower channel 98 being aligned with the lip 110 which would result in the stop barrier 101 engaging the lip 110 and preventing rotation of the adapter 10 as discussed above with respect to FIG. 8 and the track 86.

FIGS. 12–18 further illustrate the contact head 13. Specifically, the indents shown at 64, 65 accommodate the ribs 62, 63 of the slide lock collar 12. The slot shown at 116 accommodates the line conductor contact tab 23 as well as the line conductor contact tab 22. The narrower slot 117 slidably accommodates the ground conductor contact tab 25 and the slot 118 accommodates the neutral conductor contact tab 24. Referring to FIG. 13, the tongue 119 is accommodated in the slot 120 disposed in the main housing 11 (see FIG. 2). Additional design details of the contact head 13 are illustrated in FIGS. 14–18.

Figure 19:
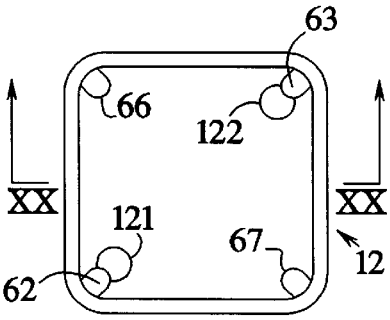
FIG. 19 is a top plan view of the slide lock collar of the adapter of the present invention.
Figure 20:
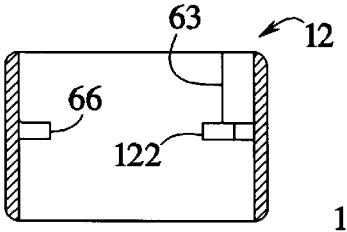
FIG. 20 is a front sectional view of the slide lock collar of FIG. 19.
Figure 21:
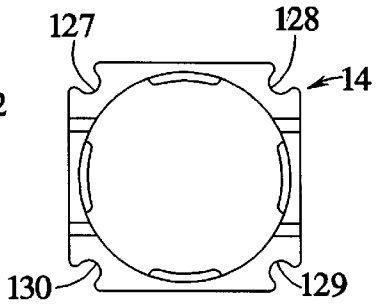
FIG. 21 is a top plan view of the lock ring of the adapter of the present invention.
Figure 22:
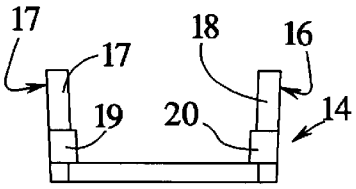
FIG. 22 is a front elevational view of the lock ring of FIG. 21.

The slide lock collar 12 is further illustrated in FIGS. 19 and 20. The keys shown at 121, 122 are accommodated within the passages 59, 60 of the main housing 11 (see also FIGS. 2 and 24). The ribs shown at 62, 63 are accommodated in the openings 123, 124 disposed in the main housing 11 (see also FIGS. 2 and 24). The keys 121, 122 support the lower end of the springs shown at 125, 126 in FIG. 2 which provide the spring bias to the collar 12. The lock ring 14 is further illustrated in FIGS. 21–23. The slots 127–130 accommodate the ribs 66, 63, 67, 62 respectively of the lock collar 12.

Details of the main housing 11 are further illustrated in FIGS. 24–25. The housing 11 includes a bottom opening 133 which accommodates the top portion of the bushing 37 (see FIG. 2) and the wires that connect the light fixtures to the contact head 13. The interior of the housing 11 also includes two upwardly extending posts 134, 135 around which lead wires 136, 137 from the light fixture are looped prior to connection to the holes 33, 34 of the conductor contact tabs 24, 22 at the contact head. This looping of the wires 136, 137 around the posts 134, 135 provide excellent pull-out protection and strain relief for the wires 134, 135 and insures that the connection between the light fixture and the contact head 13 will be long-lasting and durable.

Accordingly, a single adapter 10 has been provided which will provide an electrical and mechanical connection between a light fixture and three differently configured tracks 66, 86 and 103. While only three tracks 66, 86 and 103 are illustrated and described, it is anticipated that the adapter 10 will also provide electrical and mechanical connection to other tracks and track systems that are either currently available or will become available in the future. Accordingly, it is not anticipated that use of the adapter 10 be limited to the tracks 66, 86 and 103 as illustrated in FIGS. 3–11.

From the above description, it is apparent that the objects of the present invention have been achieved. While only a single embodiment has been set forth, alternative embodiments and various modifications will be apparent from the above description to those skilled in the art. These and other alternatives are considered equivalents and within the spirit and scope of the present invention.

What is claimed is:

1. A track lighting adapter for mechanically and electrically connecting a track light fixture to a plurality of differently configured tracks, each of said tracks having at least two conductors and one ground, the adapter comprising three conductor contact tabs and two ground contact tabs, only two of the three conductor contact tabs engaging a conductor and the other of the three conductor contact tabs not engaging any conductor when the adapter is mechanically and electrically connected to one of the tracks, and only one of the two ground contact tabs engaging a ground and the other of the two ground contact tabs not engaging any ground when the adapter is mechanically and electrically connected to one of the tracks.

2. A track lighting adapter for mechanically and electrically connecting a track light fixture to any one of a plurality of differently configured tracks of the type having a top wall disposed between a first and a second downwardly extending arms, the first arm being connected an inwardly extending first ledge, the second arm being connected an inwardly extending second ledge, the first and second inwardly extending ledges defining central channel, a line conductor being accommodated between the first ledge and the top wall a first predetermined distance above said first ledge, a neutral conductor being accommodated between the second ledge and the top wall a second predetermined distance above said second ledge, the first ledge having a first thickness, the second ledge having a second thickness, and a ground conductor, wherein at least one of the first predetermined distance, the second predetermined distance, the first thickness and the second thickness of each of the plurality of differently configured tracks differs from one another, the adapter comprising:

a contact head comprising a top end for insertion through the central channels said tracks and a bottom end for connection to a main housing, the top end of the contact head comprising a first ground contact tab that is spring biased upward for engaging the top wall of at least one of said tracks, the top end further comprising a second ground contact tab for engaging one of the ledges of at least one of said tracks, the top end of the contact head further comprises two line conductor contact tabs for engaging the line conductors of said tracks and at least one neutral conductor contact tab for engaging the neutral conductors of said tracks, one of said line conductor contact tabs being vertically displaced from the other of said line conductor contact tabs.

3. The adapter of claim 2 wherein the line conductor contact tabs are disposed on an opposing side of the top end of the contact head from the neutral conductor contact tab.

4. The adapter of claim 2 wherein the top end of the contact head further comprises a first lower pair of opposing slots for engaging the first and second ledges of at least one of said tracks and a second upper pair of opposing slots for engaging the first and second ledges of at least one of said tracks the one of the second upper pair of opposing slots being wider than the other of the second upper pair of opposing slots for accommodating at least two different track configurations.

5. The adapter of claim 2 wherein the top end of the contact head further comprises a first lower pair of opposing slots for engaging the first and second ledges of at least one of said tracks and a second upper pair of opposing slots for engaging the first and second ledges of at least two of said tracks, the second upper pair of opposing slots being disposed above the first lower pair of opposing slots, the one of the second upper pair of opposing slots being wider than the other of the second upper pair of opposing slots for accommodating at least two different track configurations.

6. The adapter of claim 2 further comprising a lock ring mounted over the top end of the contact head, the lock ring comprising an annular base for accommodating the top end of the contact head and two upwardly extending and opposing tabs, the tabs being accommodated in the central channels of the tracks.

7. The adapter of claim 6 wherein each of said tabs of said lock ring further comprises a narrow top portion and a wide bottom portion, the narrow top portion being accommodated in the central channels of all of said tracks, the wide bottom portion being accommodated in at least one central channel of said tracks and being selectively wider than the central channels of at least two of said tracks.

8. The adapter of claim 2 wherein the contact head further comprises at least one stop barrier for precluding the line conductor contact tabs from engaging the neutral conductor of a track.

9. The adapter of claim 2 wherein the contact head further comprises at least one stop barrier for precluding the neutral conductor contact tab from engaging the line conductor of a track.

10. A track lighting adapter for mechanically and electrically connecting a track light fixture to any one of a plurality of differently configured tracks of the type having a top wall disposed between a first and a second downwardly extending arms, the first arm being connected an inwardly extending first ledge, the second arm being connected an inwardly extending second ledge, the first and second inwardly extending ledges defining central channel, a line conductor being accommodated between the first ledge and the top wall a first predetermined distance above said first ledge, a neutral conductor being accommodated between the second ledge and the top wall a second predetermined distance above said second ledge, the first ledge having a first thickness, the second ledge having a second thickness, and a ground conductor, wherein at least one of the first predetermined distance, the second predetermined distance, the first thickness and the second thickness of each of the plurality of differently configured tracks differs from one another, the adapter comprising:

a contact head comprising a top end for insertion through the central channels said tracks and a bottom end for connection to a main housing, the top end of the contact head comprises two line conductor contact tabs for engaging one of the line conductors of said tracks and at least one neutral conductor contact tab for engaging one of the neutral conductors of said tracks, one of said line conductor contact tabs being vertically displaced from the other of said line conductor contact tabs, the top end of the contact head further comprises a first ground contact tab that is spring biased upward for engaging the top wall of at least one of said tracks, the top end further comprising a second ground contact tab for engaging one of the ledges of at least one of said tracks.

11. The adapter of claim 10 wherein the line conductor contact tabs are disposed on an opposing side of the top end of the contact head from the neutral conductor contact tab.

12. The adapter of claim 10 wherein the top end of the contact head further comprises a first lower pair of opposing slots for engaging the first and second ledges of at least one of said tracks and a second upper pair of opposing slots for engaging the first and second ledges of at least one of said tracks.

13. The adapter of claim 10 wherein the top end of the contact head further comprises a first lower pair of opposing slots for engaging the first and second ledges of at least one of said tracks and a second upper pair of opposing slots for engaging the first and second ledges of at least two of said tracks, the second upper pair of opposing slots being disposed above the first lower pair of opposing slots.

14. The adapter of claim 10 further comprising a lock ring mounted over the top end of the contact head, the lock ring comprising an annular base for accommodating the top end of the contact head and two upwardly extending and opposing tabs, the tabs being accommodated in the central channels of the tracks.

15. The adapter of claim 14 wherein each of said tabs of said lock ring further comprises a narrow top portion and a wide bottom portion, the narrow top portion being accommodated in the central channels of all of said tracks, the wide bottom portion being accommodated in at least one central channel of said tracks and being selectively wider than the central channels of at least two of said tracks.

16. The adapter of claim 10 wherein the contact head further comprises at least one stop barrier for precluding the line conductor contact tabs from engaging the neutral conductor of a track.

17. The adapter of claim 10 wherein the contact head further comprises at least one stop barrier for precluding the neutral conductor contact tab from engaging the line conductor of a track.

18. A track lighting adapter for providing electrical power to a track lighting fixture at any given point along a track having one of three configurations, each track having a line conductor, a neutral conductor and a ground, the connecting apparatus comprising:

a contact head comprising two ground contact tabs, two line conductor contact tabs and one neutral conductor contact tabs, one of said ground contact tabs is spring biased upward and the other of said ground contact tabs the extends outward from a side of the contact head, at least one of said line conductor contact tabs is vertically displaced from the other of said line conductor contact tabs, only one of the ground contact tabs engaging the ground of the track and the other of the ground contact tabs not engaging the track when the adapter is mechanically and electrically connected to the track, and only one of the line conductor contact tabs engaging the line conductor of the track and the other of the line conductor contact tabs not engaging any line conductor of the track when the adapter is mechanically and electrically connected to the track.

19. The adapter of claim 18 wherein the contact head further comprises top end and a bottom end, the top end of the contact head further comprises a first lower pair of opposing slots for engaging the first and second ledges of at least one of said tracks and a second upper pair of opposing slots for engaging the first and second ledges of at least one of said tracks.

20. The adapter of claim 19 wherein the second upper pair of opposing slots having different thicknesses for engaging ledges of different thicknesses.

21. The adapter of claim 18 wherein the contact head further comprises at least one stop barrier for precluding the line conductor contact tabs from engaging the neutral conductor of a track.

22. The adapter of claim 18 where in the contact head further comprises at least one stop barrier for precluding the neutral conductor contact tab from engaging the line conductor of a track.

23. The adapter of claim 18 further comprising a lock ring mounted over the contact head, the lock ring comprising an annular base for accommodating a top end of the contact head and two upwardly extending and opposing tabs, the tabs being accommodated in the central channels of the tracks.

24. The adapter of claim 23 wherein each of said tabs of said lock ring further comprises a narrow top portion and a wide bottom portion, the narrow top portion being accommodated in the of the central channels of all of said tracks, the wide bottom portion being accommodated in at least one central channel of said tracks and being selectively wider than the central channels of at least two of said tracks.

25. A ground contact mechanism for an adapter used to connect track lighting fixtures to any one of a plurality of different track configurations, the ground contact mechanism comprising:

a spring lever comprising an upper end biased in an upward direction and a lower end connected to a clip for attaching the mechanism to the adapter, the clip also being connected to a grounding post, the grounding post comprising an upwardly extending scraper end.

26. A combination lock ring and shock preventor for an adapter used to connect track lighting fixtures to any one of a plurality of different track configurations having central channels with conductors disposed inside the central channels, the adapters including at least two contact tabs for making electrical contact with said conductors, the combination lock ring and shock prevention comprising:

a spring-biased annular base ring comprising two upwardly extending and opposing tabs, each tab comprising a wide bottom portion connected to the base ring and a narrow top portion connected to the wide bottom portion opposite the base ring, the narrow top portion being accommodated in the central channels of all of said tracks, the wide bottom portion being accommodated in at least one central channel of said tracks and being selectively wider than the central channels of at least two of said tracks and preventing the at least two contact tabs of the adapter from being engaged by a user's finger.

27. A track lighting adapter for mechanically and electrically connecting a track light fixture to any one of a first, second and third differently configured tracks of the type having a top wall disposed between a first and a second downwardly extending arms, the first arm being connected an inwardly extending first ledge, the second arm being connected an inwardly extending second ledge, the first and second inwardly extending ledges defining central channel, a line conductor being accommodated between the first ledge and the top wall a first predetermined distance above said first ledge, a neutral conductor being accommodated between the second ledge and the top wall a second predetermined distance above said second ledge, the first ledge having a first thickness, the second ledge having a second thickness, and a ground conductor, wherein the first predetermined distance of the first track is different from first predetermined distance of the second and third tracks, the first predetermined distances of the second and third tracks are about the same, the second predetermined distances of the first, second and third tracks are about the same, the first thickness and the second thickness of the first track are different than the first thickness and second thickness of the second and third tracks, the first thicknesses of the second and third tracks are about the same, and the second thicknesses of the second and third tracks are about the same, the adapter comprising:

a contact head comprising a top end for insertion through the central channels said tracks and a bottom end for connection to a main housing, the top end of the contact head comprising a first ground contact tab that is spring biased upward for engaging the top wall of at least one of said tracks, the top end further comprising a second ground contact tab for engaging one of the ledges of at least one of said tracks, only one of the ground contact tabs engaging the track when the adapter is mechanically and electrically connected to the track, the top end of the contact head further comprises two line conductor contact tabs for engaging the line conductors of said tracks and at least one neutral conductor contact tab for engaging the neutral conductors of said tracks, one of said line conductor contact tabs being vertically displaced from the other of said line conductor contact tabs so that only one of the line conductor contact tabs engages the line conductor of the track when the adapter is mechanically and electrically connected to the track, the line conductor contact tabs are disposed on an opposing side of the top end of the contact head from the neutral conductor contact tabs, the top end of the contact head further comprises a first lower pair of opposing slots for engaging the first and second ledges of at least one of said tracks and a second upper pair of opposing slots for engaging the first and second ledges of at least one of said tracks, the one of the second upper pair of opposing slots being wider than the other of the second upper pair of opposing slots for accommodating at least two different track configurations.

* * * * *